US005653473A

United States Patent [19]

Laszutko et al.

[11] Patent Number: 5,653,473

[45] Date of Patent: Aug. 5, 1997

[54] MULTIPLE LABEL CONSTRUCTION HAVING TWO PRESSURE-SENSITIVE COMPOSITES LAMINATED TOGETHER

[75] Inventors: Henry A. Laszutko, Etobicoke; Ian J. Dick, Brampton, both of Canada

[73] Assignee: CCL Industries Inc., Willowdale, Canada

[21] Appl. No.: 528,599

[22] Filed: Sep. 15, 1995

Related U.S. Application Data

[63] Continuation of Ser. No. 349,071, Dec. 2, 1994, abandoned.

[51] Int. Cl.[6] ..... B42D 15/00

[52] U.S. Cl. ..... 283/81; 285/101; 285/103

[58] Field of Search ..... 283/81, 98, 101, 283/100, 103; 428/40–43; 40/299

[56] References Cited

U.S. PATENT DOCUMENTS

| | | | |
|---|---|---|---|
| 4,526,405 | 7/1985 | Hattemer | 283/81 |
| 4,767,119 | 8/1988 | Fadner et al. | 273/148 A |
| 4,846,504 | 7/1989 | MacGregor et al. | 283/102 |
| 5,071,167 | 12/1991 | O'Brien | 283/79 |
| 5,076,613 | 12/1991 | Kovacs | 283/106 |
| 5,106,124 | 4/1992 | Volkman et al. | 283/81 |
| 5,259,031 | 11/1993 | Shibahara | 283/101 X |
| 5,290,616 | 3/1994 | Cowan et al. | 283/81 X |

*Primary Examiner*—Willmon Fridie, Jr.

*Attorney, Agent, or Firm*—Warner Norcross & Judd

[57] ABSTRACT

A label includes two pressure-sensitive composites which are laminated together to provide a multiple label construction. The label can be affixed to a surface and still have a top composite removable at a later time to provide a fully pressure-sensitive label which can be reapplied to another surface.

18 Claims, 1 Drawing Sheet

MULTIPLE LABEL CONSTRUCTION HAVING TWO PRESSURE-SENSITIVE COMPOSITES LAMINATED TOGETHER

This application is a continuation of application Ser. No. 08/349,071 filed on Dec. 2, 1994 abn.

TECHNICAL FIELD

The invention relates generally, as is indicated, to a multiple label construction. More specifically, the invention relates to a multiple label construction which includes two label composites laminated together.

BACKGROUND OF THE INVENTION

A variety of different types of labels are known in the art. For example, pressure sensitive labels typically include a face material with a pressure-sensitive adhesive backing affixed to a release liner. In order to apply the label, the face material is peeled from the release liner exposing the pressure-sensitive adhesive backing. The face material is then pressed onto a surface to which it is to be adhered. The pressure exerted on the face material activates the pressure-sensitive adhesive causing the face material to be secured to the surface.

A problem associated with pressure-sensitive labels is that once the face material has been secured to the surface, the label is intended to remain secured relatively permanently. If the face material is thereafter removed from the surface, the majority of the adhesive will be left on the surface and/or otherwise will lose its adherence properties. Moreover, the pressure-sensitive adhesive which remains on the face material will likely remain exposed until the label is reapplied. Thus, great care must be taken to ensure that the face material does not come into contact any other surfaces prior to reapplication.

In view of the aforementioned drawbacks associated with conventional labels, there is a strong need in the art for a label which can be affixed to a surface and still have a top layer which can be removed at a later time to provide a fully pressure-sensitive label which can be reapplied to another surface.

SUMMARY OF THE INVENTION

A label according to a preferred embodiment of the invention includes two pressure-sensitive composites which are laminated together to provide a multiple label construction. The multiple label construction can be affixed to a surface and still have a top composite removable at a later time to provide a fully pressure-sensitive label which can be reapplied to another surface.

According to one particular aspect of the invention, a multiple label construction is provided including first and second label composites, each including a face layer releasably secured to a release layer; and means for releasably securing the first label composite to the second label composite in laminated arrangement.

According to another particular aspect of the invention, a multiple label construction is provided including first and second label composites, each including a face layer releasably secured to a release layer by a pressure-sensitive adhesive on a back surface of the face layer; and means for releasably securing the first label composite to the second label composite in laminated arrangement.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENTS

Figure 1:
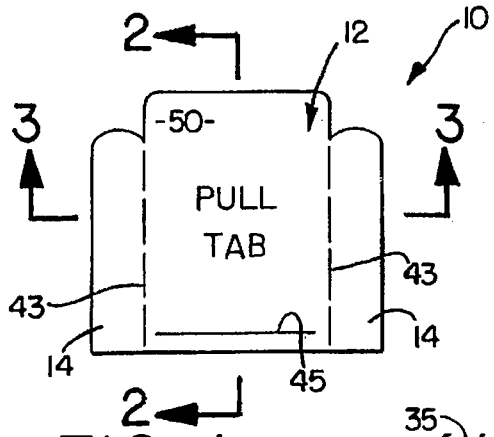
FIG. 1 is a front view of a label in accordance with a preferred embodiment of the present invention.

The present invention will now be described with reference to the drawings in which like reference numerals are used to refer to like elements throughout.

Referring initially to FIG. 1, a label having a multiple label construction in accordance with the present invention is generally designated 10. The multiple label construction 10 includes a tab section 12 bordered on each side by an adhesive bar section 14. As is shown in detail in FIGS. 2 and 3, the label 10 is made up of a first label composite 20 and a second label composite 22. The first label composite 20 includes a face layer 26 and a release layer 27 which comprises a liner 28 and a release coating 29 such as a silicone release composition which is well known in the art. The face layer 26 and release layer 27 are laminated together with a pressure-sensitive adhesive layer 30. The second label composite 22 similarly includes a face layer 34 and a release layer 35 which comprises a liner 36 and a release coating 38. The face layer 34 is laminated to the release layer 35 with a pressure-sensitive adhesive layer 40. As is shown in FIG. 3, the first and second label composites 20 and 22 are laminated together with an adhesive 42 applied between the face layers in the regions of the adhesive bar sections 14. The first and second label composites are laminated together such that the face layer 26 faces the face layer 34. The face layers are secured to each other only in the regions defined by the adhesive bar sections 14, and are otherwise unconnected in the tab section 12.

FIG. 1 shows perforations denoted by dashed lines 43 which are formed in the second label composite 22 and part of the first label composite 20 along the boundaries of the tab section 12 and the adhesive bar sections 14. By way of conventional die-cutting techniques, the perforations as represented in FIG. 3 are formed through the release layer, adhesive layer and face layer of the second label composite 22, and the face layer and adhesive layer of the first label composite 20 while preferably the release layer of the first label composite 20 remains uncut. It will be appreciated, however, that the location and depth of any such perforations can be different in other embodiments without departing from the scope of the invention. In addition, the release layer 35 of the second label composite 22 is separated by a cut line 45 near the base of the tab section 12 as is shown. The cut line 45 can be produced using conventional die-cutting techniques, and preferably only extends through the release layer 35 and does not extend into the face layer 34. In use, the perforations 43 facilitate removal of the tab section of the second label composite 22 from the first label composite 20 as is explained below in connection with FIG. 4. The cut line 45, on the other hand, facilitates removal of the release layer 35 from the face layer 34 when the face layer 34 is to be reapplied to a surface by way of pressure-sensitive adhesive 40 as is explained below with regard to FIG. 4.

The respective layers in the first and second label composites 20 and 22 are laminated together using conventional production techniques used for pressure-sensitive labels, for example. In one preferred embodiment, the face layers 26 and 34 are made from glossy paper stock. One or both of the face layers 26 and 34 can include some type of fanciful design or message such as an emblem, symbol, etc. printed on the front side of the face layer (i.e., the side opposite the side having the pressure-sensitive adhesive backing). Such designs or messages can be of the type which are printed on the face layer of a pressure sensitive label using conventional techniques. The pressure-sensitive adhesive layers 30 and 40 can consist of conventional pressure-sensitive adhesive materials as will be appreciated. Likewise, the release layers may consist of conventional paper or polymer stock coated with a release agent. The rear side of the release layers (i.e., the side opposite the side having the release agent coating) also may include some type of fanciful design or message printed thereon using conventional techniques.

Figure 4:
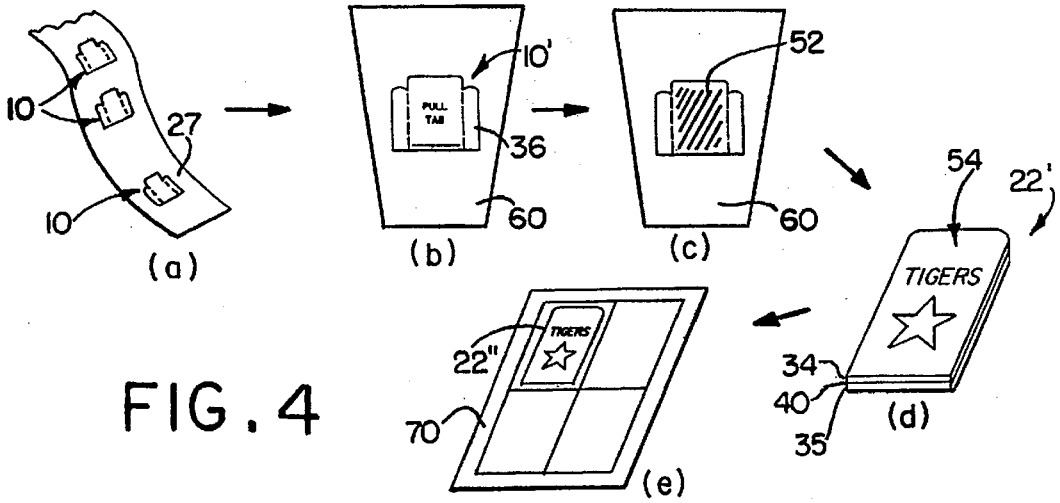
FIGS. 4(*a*) to 4(*e*) represent schematically an exemplary use of the label of FIG. 1.

In the exemplary embodiment described herein, the rear side 50 of release layer 35 has printed thereon the message "PULL TAB" as shown in FIG. 1. The front 52 (FIG. 2) of face layer 26 is blank, whereas the front 54 of face layer 34 includes a sports emblem such as "TIGERS ★" as represented in FIG. 4(*d*). It will be appreciated, however, that virtually any design, symbol, message, etc. can be printed on the face layers and/or release layers without departing from the scope of the invention.

Figure 2:
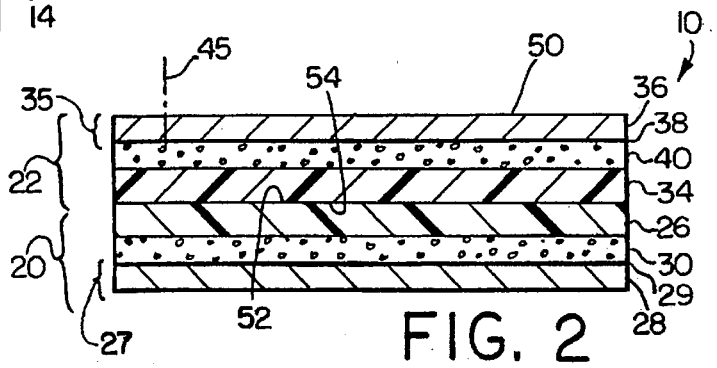
FIG. 2 is a cross sectional view of the label of FIG. 1 taken along lines 2—2 and rotated 90°.
Figure 3:
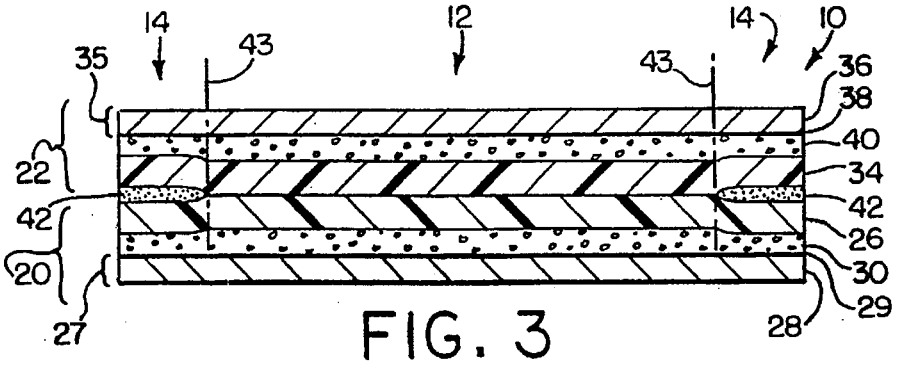
FIG. 3 is a cross sectional view of the label of FIG. 1 taken along lines 3—3.

Referring now to FIGS. 2 and 4(*a*)–4(*e*), use of the label 10 will be described. FIG. 4(*a*) shows a plurality of multiple label constructions 10 which have been produced on a common release layer 27 which can be formed in a roll, for example. An individual label is peeled and thereby separated from the release layer 27 to form a label designated 10' (FIG. 4(*b*)) with the pressure-sensitive adhesive layer 30 exposed. The label 10' can then be applied to a surface such as the surface of a cup 60 as shown in FIG. 4(*b*) using the exposed pressure-sensitive adhesive layer 30. At this time, the label 10' consists of the entire second label composite 22, and the face layer 26 and pressure-sensitive adhesive layer 30 of the first label composite laminated together by the adhesive 42 (FIG. 2).

The label 10' can be applied to and used in conjunction with the cup 60 as a promotional item in the sale of soft drinks or the like. Customers who purchase soft drinks contained in the cup are invited to pull the tab section 12 of the label 10' by the message "PULL TAB" printed on the release layer 36. Because the face layers 26 and 34 remain unconnected in the tab section 12 of the label 10', the customer can easily separate the first label composite 22 from the face layer 26 of the second label composite 20 at the top of the tab section 12 with his or her finger. The customer can then peel the tab section 12 of the first label composite 22 away from the face layer 26 adhered to the cup by tearing along the perforation lines 43 in order to expose the front 52 of face layer 26 and the front 54 of face layer 34. In a preferred embodiment, the adherence properties of the adhesive layer 30 and the adhesive 42 in the adhesive bar sections 14 are much greater than the tear resistance properties of the perforations 43. As a result, the entire tab section of the first label composite 22 can be removed with very little effort.

FIG. 4(*c*) illustrates the cup 60 after the tab section of the first label composite 22 has been removed. At this time, the tab section of the first label composite 22 as generally designated 22' in FIG. 4(*d*) consists of the tab section portions of the face layer 34, the pressure-sensitive adhesive 40, and the release layer 35. The front 54 of face layer 34 is now exposed to show the emblem, symbol, etc. printed thereon. The customer can then save the first label composite 22' and is able to reapply the label at a later time to another surface such as a game board 70 used to collect such labels as shown in FIG. 4(*e*). The customer simply peels the release layer 35 from the adhesive layer 40 by way of the cut line 45 (FIG. 1). The pressure-sensitive adhesive 40 on the back of the face layer 34 is used to secure the face layer 34 (now designated as composite 22") to the surface of the game board 70.

Thus, the multiple label construction of the present invention provides a label which can be applied to a surface and still have a top, or second, composite removable at a later time to provide a fully pressure-sensitive label which can be reapplied to another surface. The pressure-sensitive adhesive of the top or second composite remains fully protected by the release layer until the release layer is removed and the face layer of the top composite is applied to another surface.

Although the invention has been shown and described with respect to certain preferred embodiments, it is obvious that equivalents and modifications will occur to others skilled in the art upon the reading and understanding of the specification. For example, a preferred embodiment has been described as having the face layers of the respective first and second label composites laminated together by the adhesive 42. In another embodiment, however, the positions of the face layer and release layer of the second label composite can be inverted such that the face layer of the first label composite is laminated to the release layer of the second label composite. Furthermore, the first and second composites are described herein as being laminated together by an adhesive formed in the adhesive bar sections adjacent the tab section. However, different embodiments can have an adhesive located in other select regions or zones depending on the application as will be appreciated.

The face layers and the release liners have been described above as being made of paper. Any type of paper having sufficient tensile strength to be handled in conventional paper coating and treating apparatus can be employed. Thus, any type of paper can be used depending upon the end use and particular personal preferences. Included among the types of paper which can be used is paper, clay coated paper, glassine, polymer coated paper, paperboard from straw, bark, wood, cotton, flax, cornstalks, sugarcane, bagasse, bamboo, hemp, and similar cellulose materials prepared by such processes as the soda, sulfite or sulfate (Kraft) processes, the neutral sulfide cooking process, alkali-chlorine processes, nitric acid processes, semi-chemical processes, etc. Although paper of any weight can be employed, paper having weights in the range of from about 20 to about 150 pounds per ream are useful, and papers having weights in the range of from about 30 to about 100 pounds per ream are presently preferred. The term "ream" as used herein equals 3000 square feet.

The liners and face layers used in the label composite of this invention may also be made of foil paper laminations, metallized paper and polymeric materials such as polyolefins (e.g., polyethylene, polypropylene, or mixtures of polyethylene and polypropylene), polyesters, polystyrene, polyvinyl chloride, etc.

The present invention is especially suited for use in promotions and/or contests where the top label composite is separated to reveal a pressure sensitive label which can be collected on a game board or the like. There are, of course, many other uses for a label in accordance with the present invention as will be appreciated in light of the description herein. Furthermore, the first and second label composites as described herein are pressure-sensitive adhesive labels. However, other embodiments of the invention may include label composites of different construction which are releasably secured by an adhesive or the like.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A multiple label construction comprising:

first and second label composites, each including a release layer and a face layer releasably secured to the release layer by a pressure-sensitive adhesive; and means for releasably securing the first label composite to the second label composite in laminated arrangement, the securing means permitting the second label composite to be separable from the first label composite without separating either face layer from the respective release layer of either label composite.

2. A multiple label construction according to claim 1 wherein the means for releasably securing comprises an adhesive securing the face layer of the first label composite to one of the face layer and the release layer of the second label composite.

3. A multiple label construction according to claim 2 wherein the adhesive is located only in select zones between the face layer of the first label composite and the one of the face layer and the release layer of the second label composite.

4. A multiple label construction comprising:

first and second label composites, each including a face layer releasably secured to a release layer by a pressure-sensitive adhesive on a back surface of the face layer; and means for releasably securing the first label composite to the second label composite in laminated arrangement, whereby the second label composite is separable from the first label composite substantially without separating the face layer of the second label composite from the release layer of the second label composite, the securing means including an adhesive securing the face layer of the first label composite to one of the face layer and the release layer of the second label composite, the adhesive located only in select zones between the face layer of the first label composite and the one of the face layer and the release layer of the second label composite, the second label composite including perforations in areas corresponding to the select zones to facilitate separation of at least a portion of the second label composite from the first label composite.

5. A multiple label construction according to claim 1 wherein the face layer of the second label composite includes printed indicia thereon.

6. A multiple label construction according to claim 1 wherein the release layer of the second label composite includes printed indicia thereon.

7. A method for applying a multiple label to a surface, the multiple label including first and second label composites, each including a face layer releasably secured to a release layer; and means for releaseably securing the first label composite to the second label composite in laminated arrangement, the method including the steps of:

removing the second label composite in combination with the face layer of the first label composite from the release layer of the second composite;

securing the face layer of the first label composite to a surface so as to attach the second label composite to the surface;

removing the second label composite from the face layer of the first label composite substantially without separating the face layer of the second label composite from the release layer of the second label composite;

removing the face layer of the second label composite from the release layer of the second label composite; and securing the face layer of the second label composite to a surface.

8. The method of claim 7, wherein the face layer in each of the first and second label composites is releasably secured to the release layer by an adhesive on a back surface of the face layer.

9. The method of claim 8, wherein the adhesive is a pressure-sensitive adhesive.

10. The method of claim 7, wherein the means for releasably securing comprises an adhesive securing the face layer of the first label composite to one of the face layer and the release layer of the second label composite.

11. The method of claim 10, wherein the adhesive is located only in select zones between the face layer of the first label composite and the one of the face layer and the release layer of the second label composite.

12. The method of claim 11, wherein the second label composite includes perforations in areas corresponding to the select zones to facilitate separation of at least a portion of the second label composite from the first label composite.

13. A multiple label construction comprising:

first and second label composites, each including a release layer and a face layer releasably adhesively secured to the release layer; and means for releasably securing the first label composite to the second label composite in laminated arrangement, the securing means permitting the second label composite to be removed from the first label composite without separating either of the face labels from the respective release liner.

14. A multiple label construction according to claim 1 wherein the securing means comprises an adhesive securing the face layer of the first label composite to one of the face layer and the release layer of the second label composite.

15. A multiple label construction according to claim 14 wherein the adhesive is located only in select zones between the face layer of the first label composite and the one of the face layer and release layer of the second label composite.

16. A multiple label construction according to claim 15 wherein the second label composite includes perforations in areas corresponding to the select zones to facilitate separation of at least a portion of the second label composite from the first label composite.

17. A multiple label construction according to claim 14 wherein the face layer of the first label composite is secured to the face layer of the second label composite.

18. A multiple label construction according to claim 2 wherein the face layer of the first label composite is secured to the face layer of the second label composite.

* * * * *